US005813150A

United States Patent [19]

Feller et al.

[11] Patent Number: 5,813,150

[45] Date of Patent: Sep. 29, 1998

[54] SCARPER APPARATUS

[75] Inventors: Richard L. Feller; Kevin Davis, both of Monroe, Wis.

[73] Assignee: Monroe Truck Equipment Inc., Monroe, Wis.

[21] Appl. No.: 715,988

[22] Filed: Sep. 19, 1996

[51] Int. Cl.[6] ..... E02F 3/76

[52] U.S. Cl. ..... 37/234; 172/791; 172/796

[58] Field of Search ..... 37/234, 236, 407; 172/796, 799, 799.5, 821, 791; 414/912

[56] References Cited

U.S. PATENT DOCUMENTS

| | | | |
|---|---|---|---|
| 1,269,016 | 6/1918 | Staszko | 37/232 X |
| 1,805,933 | 5/1931 | Victor | 37/232 X |
| 2,292,241 | 8/1942 | Reeves | 172/781 |
| 3,086,303 | 4/1963 | Weeks | 37/232 |
| 3,355,825 | 12/1967 | Weeks | 172/796 X |
| 3,791,457 | 2/1974 | Hanser et al. | 172/781 |
| 3,858,661 | 1/1975 | Hallam et al. | 172/781 X |
| 3,858,662 | 1/1975 | Reid | 172/781 X |
| 4,058,174 | 11/1977 | Atherton et al. | 172/781 |
| 4,148,365 | 4/1979 | Anderson | 172/781 |
| 4,161,987 | 7/1979 | Tolmen | 172/796 X |
| 4,206,818 | 6/1980 | Beckham et al. | 172/781 |
| 4,258,797 | 3/1981 | McKenzle et al. | 172/796 |
| 4,279,312 | 7/1981 | Pyle | 172/793 X |
| 4,304,307 | 12/1981 | Anderson | 172/796 X |
| 4,439,939 | 4/1984 | Blau | 37/236 X |
| 5,411,102 | 5/1995 | Nickels et al. | 37/231 X |
| 5,529,131 | 6/1996 | Van Ornum | 172/796 X |

FOREIGN PATENT DOCUMENTS

| | | | |
|---|---|---|---|
| 2022173 | 12/1979 | United Kingdom | 172/796 |

*Primary Examiner*—Michael J. Carone
*Assistant Examiner*—Robert Pezzuto
*Attorney, Agent, or Firm*—David J. Archer

[57] ABSTRACT

A scraper apparatus is disposed beneath a truck for moving and scraping materials such as snow and ice. The scraper apparatus includes a moldboard scraper which is disposed beneath the truck for moving and scraping materials. A supporting table is disposed between the scraper and the truck for rotatably supporting the scraper. Also, slidable members extend from the table to the truck for permitting tilting of the table and the scraper secured thereto relative to the truck such that the moving and scraping of the materials is permitted regardless of an angle of the truck relative to a level and disposition of the materials.

1 Claim, 2 Drawing Sheets

SCARPER APPARATUS

BACKGROUND OF THE INVENTION

1. Field of the Invention

The present invention relates to a scraper apparatus disposed beneath a truck. More specifically, the present invention relates to a scraper apparatus for moving and scraping snow, ice and the like.

2. Information Disclosure Statement

In many snow moving operations, particularly if the snow and ice is hard packed, there is a need for a scraper mounted beneath a truck rather than the more usual snow plow which includes a plow blade mounted on the front of a truck.

However, during snow clearing operations, it is not unusual for snow to drift and become unevenly distributed on the ground. Accordingly, in the aforementioned circumstances, it is desirable to have a blade or moldboard that will tilt relative to the truck so that regardless of the disposition of the truck relative to the snow, the blade will be able to remove all the snow from the ground.

An example of the aforementioned underbody scraper is the apparatus built by Schmitt Engineering & Equipment Co., Ltd., of Wausau, Wis.

However, the aforementioned Schmitt underbody scraper is relatively complex and hard to service.

The present invention overcomes the aforementioned problem of the prior art underbody scraper and provides an apparatus which is extremely rugged in construction and simple to install as a retrofit.

Other objects and advantages of the present invention will be readily apparent to those skilled in the art by a consideration of the detailed description contained hereinafter taken in conjunction with the annexed drawings.

SUMMARY OF THE INVENTION

The present invention relates to a scraper apparatus which is disposed beneath a truck for moving and scraping snow, ice and like materials.

The apparatus includes a moldboard scraper which is disposed beneath the truck for moving and scraping the materials.

A supporting table is disposed between the scraper and the truck for rotatably supporting the scraper. Also, slidable means extend from the table to the truck for permitting tilting of the table and the scraper secured thereto relative to the truck. The arrangement is such that moving and scraping of the materials is permitted regardless of the angle of the truck relative to the level and disposition of the materials.

In a more specific embodiment of the present invention, the moldboard scraper includes an elongate blade which defines a cutting edge for scraping the materials. The blade also defines a supporting edge which is disposed parallel to and opposite to the cutting edge.

A support beam is disposed between the blade and the table, the beam being hingedly secured to the supporting edge of the blade.

A pivot bearing co-operates with the beam and the table for bearingly supporting the beam relative to the table for permitting reversing of the blade relative to the table.

The moldboard scraper also includes hydraulic actuating means which extend between the beam and the blade for selectively controlling an attitude of the blade relative to the materials. The actuating means also permit the selective folding of the blade to an inoperative disposition thereof beneath the table.

The moldboard scraper further includes reversing means pivotally secured to and extending between the table and the beam for selectively controlling the reversing of the blade relative to the table so that the materials can be selectively moved from either side of the blade.

Additionally, the moldboard scraper further includes, sliding hold down block means rigidly secured to the beam. The block means slidingly engage the table. The arrangement is such that the sliding block means support the beam and the blade secured thereto relative to the table even during the reversing of the blade. Also, the block means hold down the blade relative to the table during the tilting of the table.

The supporting table is of generally circular configuration and defines a central aperture for the reception therein of the pivotal bearing. The arrangement is such that the beam and the blade secured thereto are pivotally secured to the table.

More specifically, the supporting table defines a peripheral edge and the moldboard scraper is bearingly supported relative to the table about the central aperture.

The scraper also includes a first and a second hold down block. The blocks are rigidly secured to the scraper so that the blocks slidably engage diametrically opposite locations along the peripheral edge of the table for supporting the scraper relative to the table and for holding down the scraper relative to the table during tilting of the table relative to the truck. Additionally, the table also defines a first and second opening disposed on opposite sides of the central aperture. The table further includes a first and second extension defining respectively a first and a second hole.

The moldboard scraper further includes a first reversing cylinder having a first and a second end. The first end is pivotally secured to the first hole of the table and the second end is secured to the scraper about a first pivot disposed adjacent to the first opening.

A second reversing cylinder having a first and second extremity is arranged such that the first extremity is pivotally secured to the second hole of the table. The second extremity is secured to the scraper about the second pivot which is disposed adjacent to the second opening. The arrangement is such that during selective actuation of the cylinders, the scraper is reversed relative to the table.

Additionally, the table further includes a first and a second upstanding bracket disposed diametrically opposite to each other relative to the central aperture. The arrangement is such that the first and second openings are disposed between the brackets. The brackets are secured to the slidable means for slidably securing the table to the truck.

In a specific embodiment of the present invention, the slidable means includes a first and second slidable support. The first slidable support includes a first and second plate spaced relative to each other, the plates being rigidly secured to the truck.

A first movable member is disposed between the plates and is guided thereby. Additionally, the first member defines a first stop means for limiting movement of the first movable member relative to the plates.

First hinge means are provided for hingedly securing the first movable member to the table.

A first pitch cylinder is pivotally secured to the first movable member and the truck. The arrangement is such that when the first pitch cylinder is actuated, the table is tilted relative to the truck for altering a pitch of the scraper relative to the truck.

Additionally, the second slidable support includes a first and second guide spaced relative to each other. The guides are rigidly secured to the truck.

A second movable member is disposed between the guides and is guided thereby. The second member defines a second stop means for limiting movement of the second member relative to the guides.

Second hinge means are provided for hingedly connecting the second movable means to the table. The second hinge means are disposed spaced relative to the first hinge means.

A second pitch cylinder is pivotally secured to the second movable member and the truck. The arrangement is such that when the second pitch cylinder is actuated, the table is tilted relative to the truck for altering the pitch of the scraper relative to the truck.

Additionally, the first slidable support further includes a first anti-friction means disposed between the plates and the first member for permitting the slidable movement of the first member relative to the plates.

The second slidable support also includes second ant-friction means disposed between the guides and the second member for permitting the slidable movement of the second member relative to the guides.

The first anti-friction means includes first planar non-stick means disposed between the first plate and the first member. The first anti-friction means also includes second planar non-stick means disposed between the second plate and the first member.

The second anti-friction means includes first planar non-binding means disposed between the first guide and the second member and a second planar non-binding means disposed between the second guide and the second member.

In a more specific embodiment of the present invention, the first and second non-stick means and the first and the second non-binding means each include a pair of pads.

The first slidable support further includes first spacing block means disposed between the first and second plates. The arrangement is such that the plates and the first block means co-operate together for defining therebetween first guide means for guiding the first member.

The second slidable support further includes second spacing block means disposed between the first and second guides. The arrangement is such that the guides and the second block means co-operate together for defining therebetween a second guide means for guiding the second member.

The first member also includes a first arm and the first pitch cylinder has a first and a second end. The first end of the pitch cylinder is pivotally secured to the first arm. The second end of the cylinder is pivotally secured to at least one of the plates.

The second member further includes a second arm and the second pitch cylinder has a first and a second extremity. The first extremity is pivotally secured to the second arm and the second extremity of the cylinder is pivotally secured to at least one of the guides.

Many modifications and variations of the present invention will be readily apparent to those skilled in the art by a consideration of the detailed description contained hereinafter taken in conjunction with the annexed drawings. However, such modifications and variations fall within the spirit and scope of the appended claims.

BRIEF DESCRIPTION OF THE DRAWINGS

Similar reference characters refer to similar parts throughout the various views of the drawings.

DETAILED DESCRIPTION OF THE DRAWINGS

Figure 1:
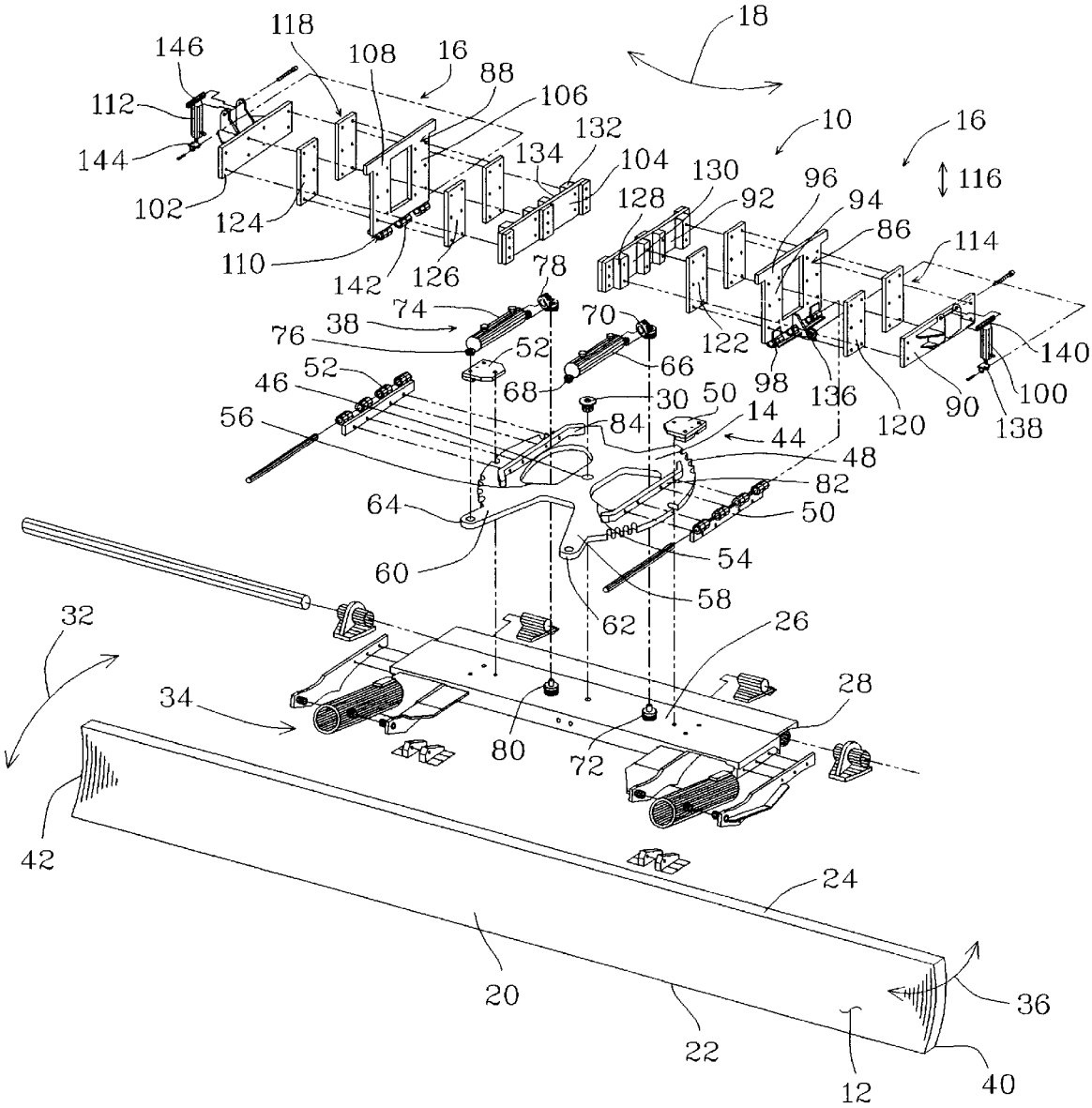
FIG. 1 is an exploded perspective view of the scraper apparatus according to the present invention.

FIG. 1 is an exploded perspective view of a scraper apparatus generally designated 10 which is disposed beneath a truck for moving and scraping snow, ice and like materials.

The apparatus 10 includes a moldboard scraper generally designated 12 disposed beneath the truck for moving and scraping the materials.

A supporting table 14 is disposed between the scraper 12 and the truck for rotatably supporting the scraper 12.

Slidable means generally designated 16 extend from the table 14 to the truck for permitting tilting as indicated by the arrow 18 of the table 14 and the scraper 12 secured thereto relative to the truck such that moving and scraping of the snow is permitted regardless of an angle of the truck relative to a level and disposition of the materials.

MOLDBOARD SCRAPER

As shown in FIG. 1, the moldboard scraper 12 includes an elongate blade 20 defining a cutting edge 22 for scraping the materials. The blade 20 also defines a supporting edge 24 which is disposed parallel to and opposite to the cutting edge 22.

A support beam 26 is disposed between the blade 20 and the table 14. The beam 26 is hingedly secured by a hinge 28 to the supporting edge 24 of the blade 20.

A pivot bearing 30 co-operates with the beam 26 and the table 14 for bearingly supporting the beam 26 relative to the table 14 for permitting reversing of the blade 20 relative to the table 14 as indicated by the arrow 32.

Figure 2:
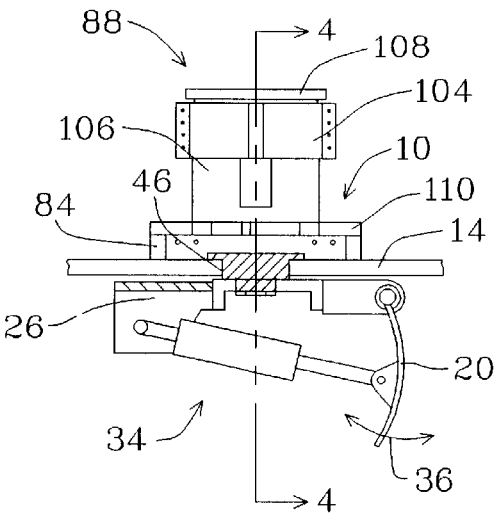
FIG. 2 is an enlarged sectional view of a portion of the scraper apparatus shown in FIG. 1.

FIG. 2 is an enlarged sectional view of a portion of the scraper apparatus 10. As shown in FIG. 2, the scraper 10 further includes hydraulic actuating means generally designated 34 extending between the beam 26 and the blade 20 for selectively controlling an attitude as indicated by the arrow 36 of the blade 20 relative to the materials.

Figure 3:
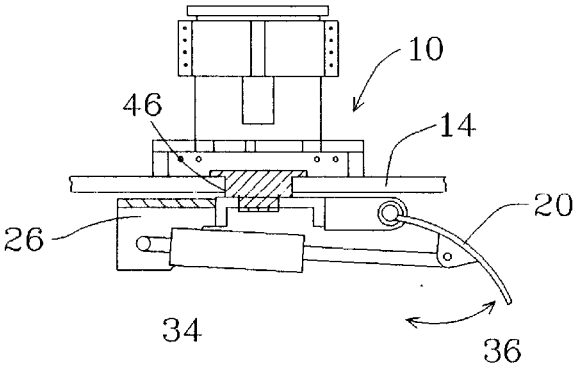
FIG. 3 is a similar view to that shown in FIG. 2 but shows the blade folded to the inoperative disposition thereof.

FIG. 3 is a similar view to that shown in FIG. 2 but shows the means 34 for selectively holding the blade 20 in an inoperative disposition thereof beneath the table 14.

Additionally, the scraper 10 further includes reversing means generally designated 38 which are pivotally secured to and extend between the table 14 and the beam 26 for selectively controlling the reversing of the blade 20 relative to the table 14 so that the materials can be selectively moved from either side 40 and 42 of the blade 20.

In a preferred embodiment of the present invention, the scraper 10 further includes sliding hold-down block means generally designated 44 rigidly secured to the beam 26. The block means 44 slidingly engage the table 14. The arrangement is such that the block means 44 support the beam 26 and the blade 20 secured thereto relative to the table 14 even during the reversing of the blade 20. Additionally, the block means 44 hold down the blade 20 relative to the table 14 during the tilting of the table 14.

SUPPORT TABLE

The support table 14 is of generally circular configuration and defines a central aperture 46.

The support table 14 is arranged such that the beam 26 and the blade 20 secured thereto are pivotally secured to the table 14.

Additionally, the table 14 defines a peripheral edge 48. The moldboard scraper 12 is bearingly supported relative to the table 14 about the central aperture 46. The scraper 12 also includes a first and second slidable hold-down blocks 50 and 52 respectively. The blocks 50 and 52 are rigidly secured to the beam 26. The arrangement is such that the blocks 50 and 52 slidable engage diametrically opposite locations along the peripheral edge 48 of the table 14 for supporting the scraper 12 relative to the table 14 and for holding down the scraper 12 relative to the table 14 during tilting of the table 14 relative to the truck.

The table 14 also defines a first and second opening 54 and 56 respectively disposed on opposite sides of the aperture 46.

The table 14 also has a first and second extension 58 and 60 defining respectively a first and second hole 62 and 64.

The moldboard scraper 12 further includes the reversing means generally designated 38 which specifically include a first reversing cylinder 66 having a first and a second end 68 and 70 respectively. The first end 68 is pivotally secured to the first hole 62 of the table 14. The second end 70 of the cylinder 66 is secured to the scraper 12 about a first pivot 72 disposed adjacent to the first opening 54 and secured to the beam 26.

A second reversing cylinder 74 has a first and second extremity 76 and 78 respectively. The first extremity 76 is pivotally secured to the second hole 64 of the table 14. The second extremity 78 is secured to the scraper 12 about a second pivot 80 which is disposed adjacent to the second opening 56 and secured to the beam 26. The arrangement is such that on selective actuation of the cylinders 66 and 74, the scraper 12 is reversed relative to the table 14.

The table 14 further includes a first and a second upstanding bracket 82 and 84 respectively disposed diametrically opposite to each other relative to the central aperture 46. The arrangement is such that the first and second openings 54 and 56 are disposed between the brackets 82 and 84. The brackets 82 and 84 are secured to the slidable means 16 for slidably securing the table 14 to the truck.

SLIDABLE MEANS

The slidable means generally designated 16 include a first and a second slidable support generally designated 86 and 88 respectively. The first slidable support 86 includes a first and a second plate 90 and 92 respectively spaced relative to each other. The plates 90 and 92 are rigidly secured to the truck.

A first movable member 94 is disposed between the plates 90 and 92 and guided thereby. The movable member 94 includes a first stop means 96 for limiting movement of the first member 94 relative to the plates 90 and 92.

A first hinge means 98 is provided for hingedly connecting the first movable member 94 to the table 14.

A first pitch cylinder 100 is pivotally secured to the first movably member 94 and to the truck. The arrangement is such that when the first pitch cylinder 100 is actuated, the table 14 is tilted relative to the truck for altering a pitch of the scraper 12 relative to the truck as described hereinafter.

The second slidable support 88 includes a first and second guide 102 and 104 respectively spaced relative to each other. The guides 102 and 104 are rigidly secured to the truck.

A second movable member 106 is disposed between the guide 102 and 104 and guided thereby. The second member 106 defines a second stop means 108 for limiting movement of the second member 106 relative to the guides 102 and 104.

Second hinge means 110 are provided for hingedly connecting the second movable member 106 to the table 14. The second hinge means 110 are disposed spaced relative to the first hinge means 98.

A second pitch cylinder 112 is pivotally secured to the second movable member 106 and the truck. The arrangement is such that when the second pitch cylinder 112 is actuated, the table 14 is tilted as indicated by the arrow 18 relative to the truck for altering the pitch of the scraper 12 relative to the truck.

The first slidable support 86 also includes a first anti-friction means generally designated 114 disposed between the plates 90 and 92 and the first member 94 for permitting the slidable movement as indicated by the arrow 116 of the first member 94 relative to the plates 90 and 92.

The second slidable support 88 also includes second anti-friction means generally designated 118 disposed between the guides 102 and 104 and the second member 106 for permitting the slidable movement of the second member 106 relative to the guides 102 and 104.

The first ant-friction means 114 includes more specifically, a first planar non-stick means 120 disposed between the first plate 90 and the first member 94. Additionally, the first anti-friction means 114 includes second planar non-stick means 122 disposed between the second plate 92 and the first member 94.

The second ant-friction means 118 includes first planar non-binding means 124 disposed between the first guide 102 and the second member 106.

Additionally, the second anti-friction means 118 includes second planar non-binding means 126 disposed between the second guide 104 and the second member 106.

More specifically, the first and second non-stick means 120 and 122 and the first and second non-binding means 124 and 126 each includes a pair of pads fabricated from PTFE (Polytetraflouroethylene).

The first slidable support 86 further includes first spacing block means 128 disposed between the first and second plates 90 and 92. The arrangement is such that the plates 90 and 92 and the block means 128 co-operate together to define therebetween first guide means 130 for guiding the first member 94.

The second slidable support 88 also includes second spacing block means 132 disposed between the first and second guides 102 and 104. The arrangement is such that the guides 102 and 104 and the second block means 132 co-operated together for defining therebetween second guide means 134 for guiding the second member 106.

The first member 94 also includes a first arm 136.

The pitch cylinder 100 has a first and second end 138 and 140 respectively, the first end 138 being pivotally secured to the first arm 136.

The second end 140 of the cylinder 100 is pivotally secured to at least one of the plates 90 or 92.

The second member 106 also includes a second arm 142. The second pitch cylinder 112 has a first and second extremity 144 and 146 respectively. The first extremity 144 is pivotally secured to the second arm 142 and the second extremity 146 of the cylinder 112 is pivotally secured to at least one of the guides 102 or 104.

Figure 4:
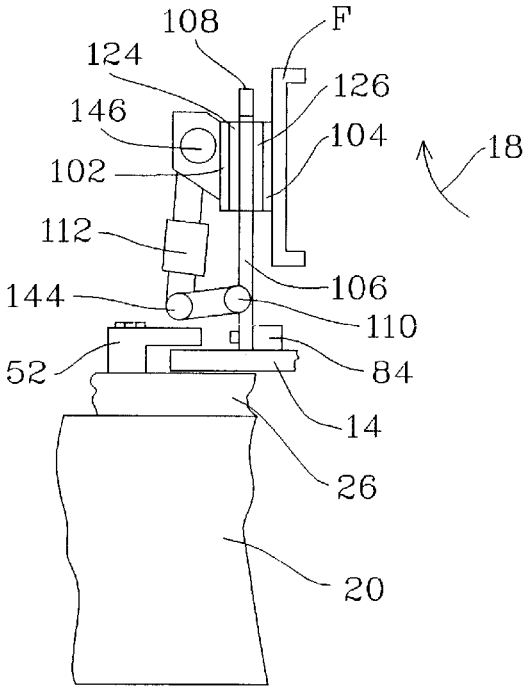
FIG. 4 is a sectional line taken on the line 4—4 of FIG. 2

FIG. 4 is a sectional view taken on the line 4—4 of FIG. 2 and shows the second pitch cylinder 112 and the pivotal connection thereof at 146 to the truck frame F. The arrangement is such that when cylinder 112 is actuated, the slidable member 106 slides upwardly between guides 102 and 104 so that the table 14 and blade 20 are tilted upwardly as indicated by the arrow 18.

The present invention provides an extremely rugged underbody scraper for removing snow and ice and the like.

Additionally, the construction of the scraper apparatus according to the present invention enables the rapid disassembly of the apparatus from beneath a truck for routine maintenance and the like.

What is claimed is:

1. A scraper apparatus disposed beneath a truck for moving and scraping materials including ice and snow, said apparatus comprising:

a moldboard scraper disposed beneath the truck for moving and scraping the materials;

a supporting table disposed between said scraper and the truck for rotatably supporting said scraper about a first axis; and slidable means extending from said table to the truck for permitting tilting of said table, said slidable means including a first and a second slidable support; said first slidable support including;

a first and second plate spaced relative to each other, said plates being rigidly secured to the truck;

a first movable member and a first anti-friction means disposed between said plates and guided thereby, said first member defining a first stop means for limiting movement of said first member relative to said plates and said first anti-friction means including a first planar non-stick means disposed between the first plate and the first member and a second planar non-stick means disposed between the second plate and said first member wherein the first anti-friction means permits the slidable movement of said first member relative to the plates;

first hinge means for hingedly connecting said first movable member to said table;

a first pitch cylinder pivotally secured to said first movable member and the truck and arranged such that when the first pitch cylinder is actuated, said table is tilted relative to the truck for altering a pitch of said scraper relative to the truck;

and said second slidable support including:

a first and second guide spaced relative to each other, said guides being rigidly secured to the truck;

a second movable member and a second anti-friction means disposed between said guides and guided thereby, said second member defining a second stop means for limiting movement of said second member relative to said guides and said second anti-friction means including a first planar non-binding means disposed between the first guide and the second member and a second planar non-binding means disposed between the second guide and said second member wherein the second anti-friction means permits permitting the slidable movement of said second member relative to the guides;

second hinge means for hingedly connecting said second movable member to said table; the second hinge means being spaced relative to the first hinge means;

a second pitch cylinder pivotally secured to said second movable member and the truck and arranged such that when the second pitch cylinder is actuated, said table is tilted relative to the truck for altering a pitch of said scraper relative to the truck; and said scraper secured thereto relative to the truck about a second axis which is disposed normal to said first axis, said second axis extending through a front and a back of the truck such that the moving and scraping of the materials is permitted regardless of an angle of the truck relative to a level and disposition of the materials.

* * * * *

UNITED STATES PATENT AND TRADEMARK OFFICE

CERTIFICATE OF CORRECTION

PATENT NO. : 5,813,150
DATED : September 29 1998.
INVENTOR(S) : Feller.

It is certified that error appears in the above-identified patent and that said Letters Patent is hereby corrected as shown below:

Column 8, line 19 delete "permitting".

Signed and Sealed this

Twenty-third Day of March, 1999

*Attest:*

Q. TODD DICKINSON

*Attesting Officer*

*Acting Commissioner of Patents and Trademarks*

UNITED STATES PATENT AND TRADEMARK OFFICE

CERTIFICATE OF CORRECTION

PATENT NO. : 5,813,150
APPLICATION NO. : 08/715988
DATED : September 29, 1998
INVENTOR(S) : Richard L. Feller and Kevin Davis It is certified that error appears in the above-identified patent and that said Letters Patent is hereby corrected as shown below:

On the Title Page, Item (54) and in the Specification, Column 1, line 1, in the title, "Scarper" should be corrected to "Scraper," with the corrected title reading "Scraper Apparatus".

Signed and Sealed this
Eighth Day of July, 2014

Michelle K. Lee

Michelle K. Lee
*Deputy Director of the United States Patent and Trademark Office*